US008114338B2

(12) United States Patent
Noda et al.

(10) Patent No.: US 8,114,338 B2
(45) **Date of Patent: *Feb. 14, 2012**

(54) TILTING-TYPE AUTOMATIC POURING METHOD AND STORAGE MEDIUM

(75) Inventors: Yoshiyuki Noda, Toyohashi (JP); Kazuhiko Terashima, Toyohashi (JP); Takanori Miyoshi, Toyohashi (JP); Makio Suzuki, Shinshiro (JP); Kazuhiro Ota, Shinshiro (JP)

(73) Assignees: Sintokogio, Ltd., Aichi (JP); National University Corporation Toyohashi University of Technology, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/597,860

(22) PCT Filed: Feb. 19, 2008

(86) PCT No.: PCT/JP2008/052723

§ 371 (c)(1),
(2), (4) Date: Oct. 27, 2009

(87) PCT Pub. No.: WO2008/136202

PCT Pub. Date: Nov. 13, 2008

(65) Prior Publication Data

US 2010/0133302 A1 Jun. 3, 2010

(30) Foreign Application Priority Data

Apr. 28, 2007 (JP) ..... 2007-120365

(51) Int. Cl.
*C21B 13/00* (2006.01)

(52) U.S. Cl. ..... 266/44; 222/590; 266/96

(58) Field of Classification Search ..... 266/44, 266/99, 98, 236; 222/590
See application file for complete search history.

(56) References Cited

U.S. PATENT DOCUMENTS 6,280,499 B1 * 8/2001 Koffron ..... 75/375
(Continued)

FOREIGN PATENT DOCUMENTS

JP 62-11290 3/1987
(Continued)

OTHER PUBLICATIONS

Kazuhiro Shinohara et al., "Development of Automatic Pouring Equipment," Automobile Technology, 1992, vol. 46, No. 11, 79-86.

*Primary Examiner* — Scott Kastler
(74) *Attorney, Agent, or Firm* — Finnegan, Henderson, Farabow, Garrett & Dunner, L.L.P.

(57) ABSTRACT

A tilting-type automatic pouring method for pouring molten metal from a ladle with an outflow position into a mold. The method includes tilting the ladle forward to pour molten metal into the mold, measuring a weight of poured molten metal, calculating a flow rate of the molten metal flowing out of the ladle based on the measured weight of poured molten metal, estimating a weight of molten metal that will be poured during a backward tilting. The method also includes estimating a total weight of molten metal based on the measured weight of poured molten metal and the estimated weight of molten metal that will be poured during the backward tilting and comparing the estimated total weight of molten metal to a predetermined weight. When the estimated total weight is equal to or larger than the predetermined weight, the backward tilting is started.

3 Claims, 6 Drawing Sheets

U.S. PATENT DOCUMENTS

| | | | | |
|---|---|---|---|---|
| 2010/0010661 | A1* | 1/2010 | Terashima et al. | 700/146 |
| 2010/0059555 | A1* | 3/2010 | Noda et al. | 222/604 |
| 2010/0116855 | A1* | 5/2010 | Noda et al. | 222/590 |

FOREIGN PATENT DOCUMENTS

| | | | |
|---|---|---|---|
| JP | 6-262343 | | 9/1994 |
| JP | 6-344125 | | 12/1994 |
| JP | 9-239525 | | 9/1997 |
| JP | 10-58120 | | 3/1998 |
| JP | 11-123532 | | 5/1999 |
| JP | 3526501 | | 2/2004 |
| JP | 2005-88041 | | 4/2005 |
| WO | WO 2007/119697 | A1 | 10/2007 |

* cited by examiner

TILTING-TYPE AUTOMATIC POURING METHOD AND STORAGE MEDIUM

TECHNOLOGICAL FIELD

This invention relates to a tilting-type automatic pouring method and storage medium. More particularly, it relates to the tilting-type automatic pouring method that comprises holding a predetermined amount of molten liquid (molten metal) such as molten iron and aluminum in a ladle, then pouring it into a mold by tilting the ladle, and it also relates to the storage medium for programs for controlling the pouring of the molten liquid into the mold.

BACKGROUND OF THE INVENTION

Conventionally the tilting-type automatic pouring methods comprises one that controls the tilting speed of a ladle so that the constant flow rate of molten metal is maintained (see Patent document 1), that pours the predetermined weight of the molten metal in the shortest time (see Patent document 2), that controls the tilting speed of the ladle so that a desired flow pattern is realized (see Non-Patent document 1), or that uses a fuzzy control (see Non-Patent document 2).

Patent document 1: Publication of Unexamined Patent Application, Publication No. H09-239525

Patent document 2: Publication of Unexamined Patent Application Publication No. H10-58120

Non-Patent document 1: Patent Application No. 2006-111883

Non-Patent document 2: Automobile Technology, Vol. 46, No. 11, pp 79-86, 1992

DISCLOSURE OF THE INVENTION

The method of Patent document 1 or Non-Patent document 1 controls the weight of the molten metal that is poured per unit of time (the flow rate of the molten metal). Thus, to obtain accurately the desired weight of the molten metal that is poured into the mold is difficult. The method of Patent document 2 or Non-Patent document 2 can pour accurately the desired weight of the molten metal that is to be poured. However, the pouring method of Patent document 2 or non-Patent document 2 requires a number of basic experiments and the time to set up a necessary control system. Also, in the pouring method of Patent document 2, for pouring at a high speed the backward tilting of a ladle must be carried out in several separate movements because otherwise the difference between the weight of the molten metal poured that is calculated from the experiments and the weight of the molten metal actually poured obtained becomes great. As a result, the time required for the backward tilting becomes longer.

Also, in the method of Patent document 2 or Non-Patent document 2, the fact that the response characteristics of a load cell that measures the weight of the molten metal that is poured greatly affects the accuracy of the weight is a problem.

In view of the above, the present invention provides a tilting-type automatic pouring method wherein a very speedy and highly accurate pouring can be realized, which method pours molten metal into a mold by tilting a ladle that holds the molten metal. The present invention also provides the storage medium for programs used for the method.

1) The tilting-type automatic pouring method of the present invention is one wherein molten metal is poured into a mold from a ladle that has an outflow position of a predetermined shape, by tilting the ladle backward after tilting it forward, 2) wherein the tilting-type automatic pouring method of the present invention uses a) the relationship of (1) the height of the molten metal during backward tilting of the ladle, which height is calculated from the height of the molten metal above the outflow position, when the forward tilting of the ladle stops, and from the height of the molten metal that is above the outflow position and that decreases after the backward tilting of the ladle starts, and (2) the weight of the molten metal poured from the ladle into the mold, and b) the model expression for the flow of the molten metal, which expression defines the weight of the molten metal that flows from the ladle into the mold.

3) wherein the final weight of the molten metal that is poured is estimated by assuming that the final weight of the molten metal that is poured from the forward tilting of the ladle to its backward tilting is equal to the sum of the weight of the molten metal that is poured at the start of the backward tilting and the weight of the molten metal that is poured after the start of the backward tilting, 4) wherein the backward tilting of the ladle is started based on the results of evaluation on whether the estimated final weight of the molten metal that is to be poured is equal to the weight of the molten metal that is the desired weight to be poured.

5) Also, the storage medium of the present invention stores the programs that make a computer operate, so that the backward tilting of the ladle is started by using a model expression for the flow of the molten metal that flows from the ladle into the mold, and estimating the final pouring weight, 6) wherein the computer comprises:

a storage means that stores the model expression for the flow of the molten metal;

a calculating means that calculates the angle of the tilting of the ladle when it actually starts pouring the molten metal based on the angle of the tilting of the ladle when it should start pouring, which angle is determined by a load cell;

a calculating means that calculates the volume of the molten metal in the ladle at the start of pouring, based on the angle of the tilting of the ladle when it actually starts pouring;

a calculating means that calculates the height of the molten metal in the ladle during the backward tilting of the ladle, which height is calculated from the difference between the height of the molten metal above the outflow position, when the forward tilting of the ladle stops, and the height of the molten metal that is above the outflow position and that decreases after the backward tilting of the ladle starts;

a calculating means that calculates the weight of the molten metal poured after the start of the backward tilting of the ladle;

a calculating means that calculates the weight of the molten metal poured at the start of the backward tilting of the ladle;

a converting means that converts the weight of the molten metal that flows from the ladle into the mold to the weight of the molten metal that is poured, which the load cell measures as the weight of the molten metal poured;

a calculating means that calculates the final weight of the molten metal that is poured by assuming that the final weight of the molten metal that is poured from the forward tilting of the ladle to its backward tilting is equal to the sum of the weight of the molten metal that is poured at the start of the backward tilting and the weight of the molten metal that is poured after the start of the backward tilting; and a means to determine whether the final weight that is estimated as the one that should be poured is equal to the predetermined weight to be poured.

With the method of the present invention, the molten metal can be poured speedily and accurately into the mold to the level of the predetermined weight of the molten metal to be poured. This is because with this method the weight of the molten metal to be poured is estimated, and because if the estimated weight is the same as or above the predetermined weight, the backward tilting of the ladle is started.

BEST MODE OF THE EMBODIMENT OF THE INVENTION

One embodiment of the tilting-type automatic pouring equipment to which the method of the present invention is applied is now explained based on the attached drawings. As shown in FIG. 1, the tilting-type automatic pouring equipment of the embodiment comprises a cylindrical ladle 1 having a outflow position that is rectangular; a servomotor 2 that tilts this ladle 1; a transfer means 4 that moves the ladle 1 vertically with a ball screw mechanism that converts the rotating movement of the output-axis of the servomotor 3 into linear movement; a transfer means 6 that moves the ladle 1 horizontally by means of a rack and pinion mechanism that converts the rotating movement of the output-axis of the servomotor 5 into linear movement; a load cell (not shown) that measures the weight of the molten metal in the ladle 1; and a control system 8 that utilizes a computer, which is a controller or a program logic controller (PLC 7) that calculates and controls the movements of the servomotor 2 and the transfer means 4. Also, the load cell is connected to a load cell amplifier. The position and the angle of the tilting of the ladle 1 are measured by rotary encoders (not shown), attached to the respective servomotors 2, 3, 5. The signals on the measurements and the instructions for control are given to the servomotors 2, 3, 5, from the PLC 7.

Also, the control system 8 comprises:

a storage means that stores the model expressions for the flow of the molten metal;

a calculating means that calculates the angle of the tilting of the ladle when it actually starts pouring based on the angle of the tilting of the ladle at the start of the pouring, which angle is determined by the load cell;

a calculating means that calculates the volume of the molten metal in the ladle at the start of pouring, based on the angle of the tilting of the ladle when it actually starts pouring;

a calculating means that calculates the height of the molten metal in the ladle during the backward tilting of the ladle, which height is calculated from the difference between the height of the molten metal above the outflow position, when the forward tilting of the ladle stops and the height of the molten metal that is above the outflow position and that decreases after the backward tilting of the ladle starts;

a calculating means that calculates the weight of the molten metal that was poured after the backward tilting of the ladle starts;

a calculating means that calculates the weight of the molten metal that has been poured when the backward tilting of the ladle starts;

a converting means that converts the weight of the molten metal that flows from the ladle into the mold to the weight of the molten metal that the load cell measures as the weight of the molten metal poured;

a calculating means that calculates the final weight of the molten metal that is poured by assuming that the final weight of the molten metal that is poured from the forward tilting of the ladle to its backward tilting is equal to the sum of the weight of the molten metal that is poured when the backward tilting of the ladle starts and the weight of the molten metal after the backward tilting of the ladle starts; and programs that work as a means to determine whether the estimated final weight of the molten metal is equal to the weight of the molten metal that is predetermined.

The ladle 1 has the output-axis of the servomotor 2 connected to its position of the center of gravity and is rotatably supported at its position. Around this position, the ladle can tilt forward toward the sprue of the mold and also can tilt backward, thereby distancing itself from the sprue of the mold (the movement to stop pouring). By having the ladle tilt around its center of gravity, the load that weighs on the servomotor is reduced.

Also, the transfer means 4, 6 move the ladle 1 backward and forward, and up and down in coordination with the tilting of the ladle 1, so as to have the molten metal accurately poured into the sprue of the mold, whereby the ladle can have an imaginary rotating axis at the tip of the outflow position as a fixed pouring point and rotate around it.

In the present embodiment, the tilting-type automatic pouring method of the present invention uses a) the relationship of (1) the height of the molten metal during the backward tilting of the ladle, which height is calculated from the height of the molten metal above the outflow position, when the forward tilting of the ladle stops and from the height of the molten metal that is above the outflow position and that decreases after the backward tilting of the ladle starts, and (2) the weight of the molten metal poured from the ladle into the mold, and b) the model expression for the flow of the molten metal, which expression defines the weight of the molten metal that flows from the ladle into the mold.

This model expression for the flow of the molten metal defines the relationship between the relevant factors from the input electric voltage of the servomotor that tilts the ladle to the weight of the molten metal that flows from the ladle, and which weight is measured by the load cell.

First, in FIG. 2, which shows a vertical cross-section of the ladle 1 when it is pouring, given that θ (deg.) is the angle of the tilting of the ladle 1, Vs (θ) ($m^3$) is the volume of the molten metal below the line which runs horizontally through the outflow position 11, which is the center of the tilting of the ladle 1, A (θ) ($m^2$) is the horizontal area on the outflow position 11, Vr ($m^3$) is the volume of the molten metal above the outflow position 11, h (m) is the height of the molten metal above the outflow position 11, and q ($m^3$/s) is the volume of the molten metal that flows from the ladle 1. Then the expression that shows the balance of the molten metal in the ladle 1 from the time, t (s), to the Δt after t (s), is given by the following expression (1):

$$V_r(t)+V_s(\theta(t))=V_r(t+\Delta t)+V_s(\theta(t+\Delta t))+q(t)\Delta t \tag{1}$$

If the terms that have Vr ($m^3$) in expression (1) are brought together and Δt is caused to be →0, the following expression (2) is obtained:

$$\begin{aligned}\lim_{\Delta t\to 0}\frac{V_r(t+\Delta t)-V_r(t)}{\Delta t} &= \frac{dV_r(t)}{dt}\\ &= -q(t)-\frac{dV_s(\theta(t))}{dt}\\ &= -q(t)-\frac{\partial V_s(\theta(t))}{\partial\theta(t)}\frac{d\theta(t)}{dt}\end{aligned} \tag{2}$$

Also, the angular velocity of the tilting of the ladle 1, ω (deg./s), is defined by the following expression (3):

$$\omega=d\theta(t)/dt \tag{3}$$

If expression (3) is substituted for the value in expression (2), then expression (4) is obtained.

$$\frac{dV_r(t)}{dt} = -q(t) - \frac{\partial V_s(\theta(t))}{\partial \theta(t)}\omega(t) \tag{4}$$

The volume of the molten metal above the outflow position, Vr ($m^3$), is given by the following expression (5):

$$V_r(t) = \int_0^{h(t)} A_s(\theta(t), h_s)\,dh_s \tag{5}$$

Area $A_s$ shows the horizontal area ($m^2$) of the molten metal at height $h_s$ (m) above the horizontal area on the outflow position 11 as shown in FIG. 2.

Also, if area $A_s$ ($m^2$) is broken down into the horizontal area of the outflow position A ($m^2$) and the amount of the change of area $\Delta A_s$ ($m^2$) over the area A ($m^2$), then the volume Vr ($m^3$) is given by the following expression (6):

$$\begin{aligned} V_r(t) &= \int_0^{h(t)} (A(\theta(t)) + \Delta A_s(\theta(t), h_s))\,dh_s \\ &= A(\theta(t))h(t) + \int_0^{h(t)} \Delta A_s(\theta(t), h_s)\,dh_s \end{aligned} \tag{6}$$

With ladles in general, including the ladle 1, because the amount of the change of area $\Delta A_s$ is very small compared to the horizontal area on the outflow position, A, the following expression (7) is obtained:

$$A(\theta(t))h(t) \gg \int_0^{h(t)} \Delta A_s(\theta(t), h_s)\,dh_s \tag{7}$$

Thus expression (6) can be shown as the following expression (8):

$$V_r(t) \approx A(\theta(t))h(t) \tag{8}$$

Then the following expression (9) is obtained from the expression (8):

$$h(t) \approx V_{r(t)/A(\theta(t))} \tag{9}$$

The flow of the molten metal q ($m^3/s$) that flows from the ladle 1 at height h (m) above the outflow position is obtained from Bernoulli's theorem. It is given by the following expression (10):

$$q(t) = c\int_0^{h(t)} \left(L_f(h_b)\sqrt{2gh_b}\right)dh_b,\ (0 < c < 1) \tag{10}$$

wherein $h_b$ is, as shown in FIG. 3, the depth (m) of the molten metal in the ladle 1 from its surface, $L_f$ is the width (m) of the outflow position 11 at depth $h_b$ (m) of the molten metal, c is the coefficient of the flow of the molten metal that flows, and g is the gravitational acceleration.

Also, the relationship of the flow rate of the molten metal that flows from the ladle 1, q ($m^3/s$), and the weight of the molten metal that is poured, w(kg), is given by the following expression (11):

$$\frac{dw(t)}{dt} = \rho q(t) \tag{11}$$

wherein ρ ($kg/m^3$) is the density of the molten metal. Further, the following expressions (12) and (13), which are the basic model expressions for the flow of the molten metal, are obtained from expressions (4), (9) and (10):

$$\frac{dV_r(t)}{dt} = -c\int_0^{\frac{V_r(t)}{A(\theta(t))}} \left(L_f(h_b)\sqrt{2gh_b}\right)dh_b - \frac{\partial V_s(\theta(t))}{\partial \theta}\omega(t) \tag{12}$$

$$q(t) = c\int_0^{\frac{V_r(t)}{A(\theta(t))}} \left(L_f(h_b)\sqrt{2gh_b}\right)dh_b,\ (0 < c < 1) \tag{13}$$

Further, the width $L_f$ of the outflow position 11 of the ladle 1, which position has a rectangular shape, is constant in relation to the depth $h_b$ from the surface of the molten metal in the ladle 1. Thus, the flow rate of the molten metal, q, is given by the following expression (14) from the expression (10):

$$q(t) = \frac{2}{3}cL_f\sqrt{2gh_b}\,(t)^{3/2},\ (0 < c < 1) \tag{14}$$

Thus, if expression (14) is substituted for the values in expressions (12) and (13), which are the basic expressions for the flow of the molten metal that is poured, then the model expressions for the flow of the molten metal that is poured are given by the following expressions (15) and (16):

$$\frac{dV_r(t)}{dt} = -\frac{2cL_f\sqrt{2g}}{3A(\theta(t))^{3/2}}V_r(t)^{3/2} - \frac{\partial V_s(\theta(t))}{\partial \theta}\omega(t) \tag{15}$$

$$q(t) = \frac{2cL_f\sqrt{2g}}{3A(\theta(t))^{3/2}}V_r(t)^{3/2},\ (0 < c < 1) \tag{16}$$

The horizontal area on the outflow position, A (θ)($m^2$), changes depending on the angle of the tilting of the ladle 1, (θ) (deg.). Thus model expressions (15) and (16) for the flow of the molten metal will be non-linear models. Their parameters are variable depending on how the system matrix, input matrix, and output matrix vary based on the angle of the tilting of the ladle 1.

Next, from expressions (10) and (11), it is seen that if the pattern of the backward tilting movement of the ladle 1 is fixed, the relationship between the weight of the molten metal poured after the start of the backward tilting, w (kg), and the height of the molten metal above the outflow position 11, h (m), is given as shown in FIG. 4.

The upper graph of FIG. 4 shows the height of the molten metal in the ladle during pouring. The lower graph shows the weight of the molten metal that is poured. The solid line in the upper graph shows the height of the molten metal above the outflow position of the ladle when the tilting of the ladle 1 stops. The dotted line shows the height of the molten metal that decreases after the ladle starts a backward tilting. The difference between the solid line and the dotted line shows the height of the molten metal above the outflow position of the ladle, h(m), during the backward tilting of the ladle. Thus for the length of time after both lines cross, the height above the outflow position of the ladle becomes null or below zero. This means that the ladle 1 ceases pouring the molten metal. The height of the molten metal when the ladle stops tilting (the solid line in the upper graph), which height corresponds to and is represented by the free response of the model expression for the flow of the molten metal, is given by the following expressions (17) and (18).

$$\frac{dV_r(t)}{dt} = c\int_0^{h(t)} \left(L_f(h_b)\sqrt{2gh_b}\right) dh_b \tag{17}$$

$$h(t) = \frac{V_r(t)}{A(\theta(t))} \tag{18}$$

wherein, as shown in FIG. 2, Vr ($m^3$) is the volume of the molten metal above the outflow position 11, and A (θ) ($m^2$) is the horizontal area on the level of the tip of the outflow position 11. Thus, if the ladle is to repeat the same backward tilting movement, the weight of the molten metal that is poured after the ladle starts the backward tilting depends on the height of the molten metal at the start of the backward tilting and the horizontal area on the level of the tip of the outflow position. Therefore the weight of the molten metal that is poured, $w_e$ (kg), after the start of the backward tilting, is obtained from the simulated experiment, wherein the height of the molten metal above the outflow position $h_s$ ($t_1$) (s) and the angle of the tilting θ ($t_1$) (deg) of the ladle 1 at the time ($t_1$) (s) of the start of the backward tilting are taken as the boundary conditions.

By changing the boundary conditions and making simulated experiments for each of the boundary conditions, the relationship between the height of the molten metal at the start of the backward tilting, and the weight of the molten metal for the angle of the tilting, which is poured after the start of the backward tilting, is obtained from the following expressions.

$$W_e = \rho\int_{t_1}^{t_2} f(h_s(h_s(t_1), \theta(t_1)) - h_e(\theta(t_1)))\, dt$$

wherein $$w_e = \sum_{i=0}^{n} A_i h_s^i$$

$$A_i = \sum_{k=0}^{m} B_{ik}\theta^k$$

wherein h is the height (m) of the liquid that decreases in the backward tilting, and $t_1$ is the time when the pouring of molten metal stops. These expressions are approximated and then the following polynomial expression (19) is obtained:

$$w_e(\theta, h) = \sum_{i=0}^{m}\sum_{k=0}^{n} B_{ik}\,\theta(t_1)^k h(t_1)^i \tag{19}$$

wherein i, k are the degrees of the approximated polynomial expression and $B_{jk}$ is a coefficient of the polynomial expression.

The weight of the molten metal, $w_e$ (kg), that is poured after the start of the backward tilting, can be estimated from the expression (19), by substituting the angle of the tilting, θ (deg), of the ladle 1 and the height of the molten metal above the outflow position, h (m), at the time, $t_1$ (s), of the start of the backward tilting for the values in the expression (19). The weight of the total molten metal, w (kg), that is poured can be estimated if the weight of the molten metal, $w_b$ (kg), that is poured at the time of the start of the backward tilting is added as given by the following expression (20).

$$w = w_b(t_1) + w_e(t_1) \tag{20}$$

wherein the height of the molten metal above the outflow position is obtained from the expression (21).

$$h(t) = \frac{V_{sb} - V_s(\theta(t)) - w(t)/\rho}{A(\theta(t))} \tag{21}$$

wherein $V_{sb}$($m^3$) is the volume of the molten metal below the line which runs horizontally through the outflow position at the start of the pouring of the molten metal. $V_s$($m^3$) is the volume of the molten metal in the ladle, as shown in FIG. 2, at the time t(s). But in expression (21), w is the molten metal that is actually poured. It is different from the weight that is measured by the load cell as having been poured. So, the relationship between the weight w (kg) that is actually poured and the weight $w_L$ (kg) that is measured by the load cell as having been poured can be given by the following expression (22) if the response characteristics of the load cell are expressed in the first order lag element.

$$w = T_L\frac{dw_L}{dt} + w_L \tag{22}$$

$T_L$(s) is the time constant of the load cell. By approximating the expression (22), the weight of the molten metal that is actually poured is obtained as given in the expression (23):

$$w = T_L\overline{w}_L + w_L \tag{23}$$

wherein w (with an upper bar) is a constant and it is assumed to be an average of $dw_L/dt$. The volume of the molten metal in the ladle at the start of the pouring can be calculated from the angle of the tilting of the ladle at the start of the pouring, if a sensor to detect the pouring is provided. But from the weight that is measured by the load cell as having been poured, to determine whether the pouring is started is difficult. Thus, a simulated experiment is carried out by using a model mathematical expression for the pouring of the molten metal wherein a series of movements is simulated, comprising tilting the ladle at a constant angular velocity, which tilting makes the weight of the molten metal as measured by the load cell as having been poured increase, and determining by the load cell if the pouring is started. The boundary conditions in this simulation typically include the angle of the tilting of the ladle, $\theta_b$(deg), when the ladle actually starts pouring. The simulation is carried out for each of the boundary conditions. From the simulation, the relationship between the angle of the tilting of the ladle at the time of the start of the actual pouring and the angle of the tilting of the ladle 1, $\theta_{Lb}$(deg), at the time of the start of pouring as determined by the load cell, is obtained, as given in expression (24), from the angle of the tilting of the ladle 1 as determined by the load cell at the start of the pouring.

$$\theta_b = f(\theta_{Lb}) \tag{24}$$

Then the volume of the molten metal in the ladle can be obtained from the shape of the ladle and the angle of the tilting of the ladle by a geometrical calculation. Then, the volume of the molten metal in the ladle can be obtained for any particular angle of the tilting of the ladle. Thus the volume $V_{sb}$ of the molten metal in the ladle at the start of pouring can be estimated by the expression: $V_{sb}=f(\theta_b(\theta_b)(t))$ from the angle of the tilting $\theta_b$ (deg.) of the ladle at the start of the tilting and the expression (24).

Also, $w_b$ (kg) of expression (20) is the weight of the molten metal actually poured, which weight has a relationship with the weight of the molten metal that is measured by the load cell, which relationship is given in expression (22). So, $w_b$ (kg) can be obtained from expressions (11) and (22) as follows:

$$w=T_L\rho q_L+w_L \tag{25}$$

$$q_c = T_L\frac{dq_{cL}}{dt} + q_{cL} \tag{26}$$

wherein $q_{cL}$ is the flow rate that is the actual flow rate as modified by the dynamic characteristics of the load cell.

$$q_c(t) = c\int_0^{h(t)}\left(L_f(h_b)\sqrt{2gh_b}\right)dh_b \ldots \tag{27}$$

The height of the molten metal above the outflow position as in the expression (21) is substituted for the value in expression (27). Then the value obtained for the flow rate $q_c$ (t) ($m^3/s$) is substituted for the value in expression (26).

Incidentally, the weight that is measured by the load cell as having been poured is different from the weight that is actually poured (less than the weight that is actually poured) because of the delay in the response.

Thus the weight that is actually poured can be estimated from the weight that is measured by the load cell as having been poured, by solving each of expressions (21), (27), (26), and (25), in that order. In the process of calculating the estimate, the flow rate of expression (27) is used. By having the flow rate be substituted for the value in the expression (25), the weight that is actually poured at the start of backward tilting, $w_b$, can be obtained. The ladle starts backward tilting when the following discriminant is satisfied.

$$w_{ref}\leqq w(t_1)=w_b+w_e(h_s,\theta) \tag{28}$$

$W_{ret}$ (kg) is a targeted weight that is to be poured.

FIG. 5 shows a flow chart illustrating how the weight that is poured is controlled. Parameters A and D (kg) give respectively the weight on which is based the start of pouring and the weight on which is based the completion of the forward tilting of the ladle.

FIG. 6 shows the result of an experiment that was carried out using automatic water pouring equipment that used water in place of molten metal to control the weight that was to be poured.

The upper graph shows the angle of the tilting of the ladle 1 and the lower graph shows the weight that is measured by the load cell as having been poured. The targeted weight that was to be poured was 0.783 (kg). Against this, with automatic water pouring equipment, wherein the weight of water that was poured was controlled, the weight of the water that was poured was 0.78 (kg). Thus, the difference in the weight was equal to 0.4(%).

The time for pouring was 8 (sec), which is 4 (sec.) less than the conventional fixed sequence of 12 (sec.).

The basic Japanese Patent Application, No. 2007-120365, filed on Apr. 28, 2007, is hereby incorporated in its entirety by reference in the present application.

The present invention will become more fully understood from the detailed description of this specification. However, the detailed description and the specific embodiment only illustrate desired embodiments of the present invention, and are given only for an explanation. Various possible changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not limit the scope of the invention unless otherwise claimed.

SYMBOLS

Figure 1:
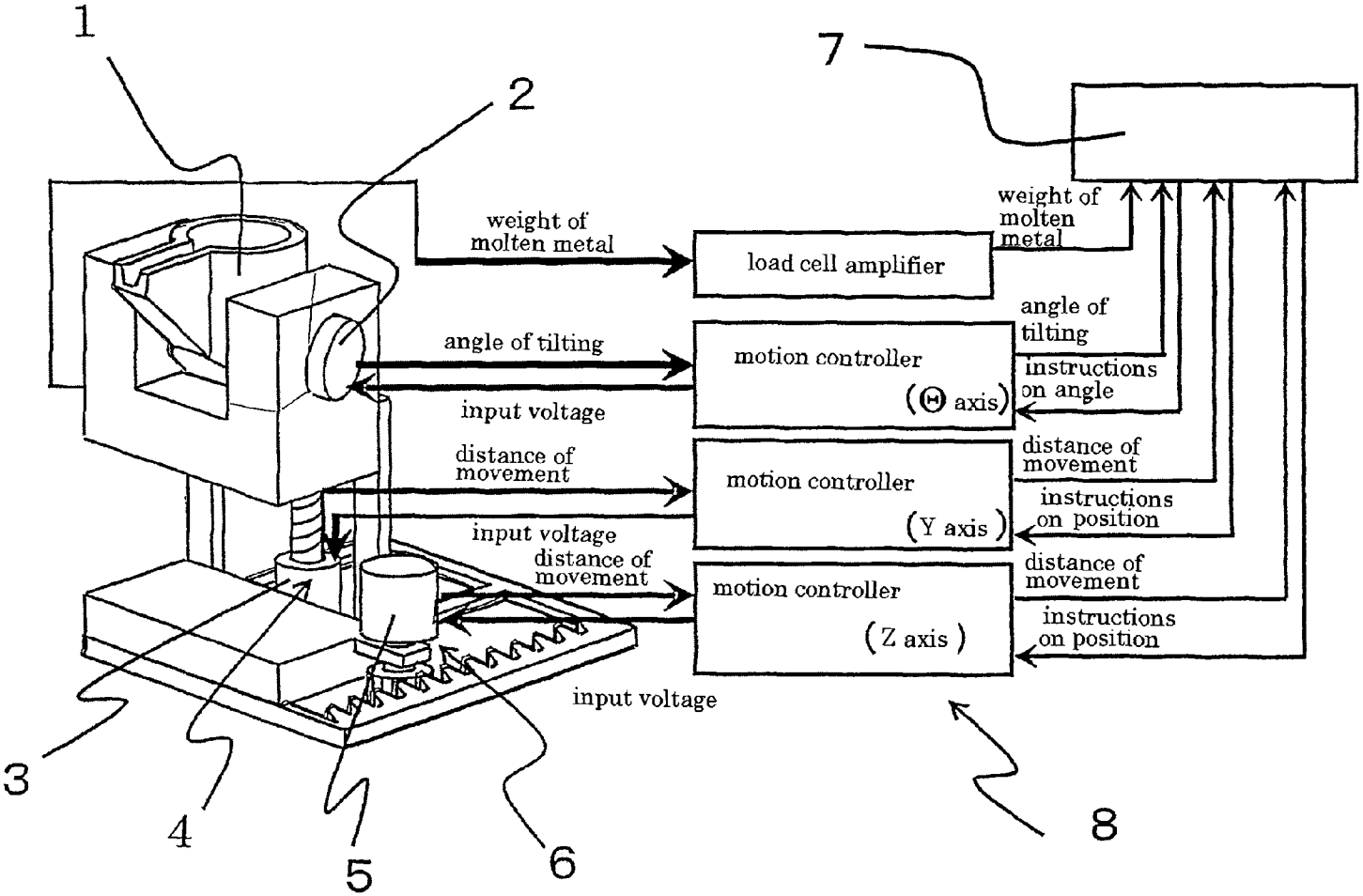
FIG. 1 shows a schematic view of the tilting-type automatic pouring equipment to which the present invention is applied.
Figure 2:
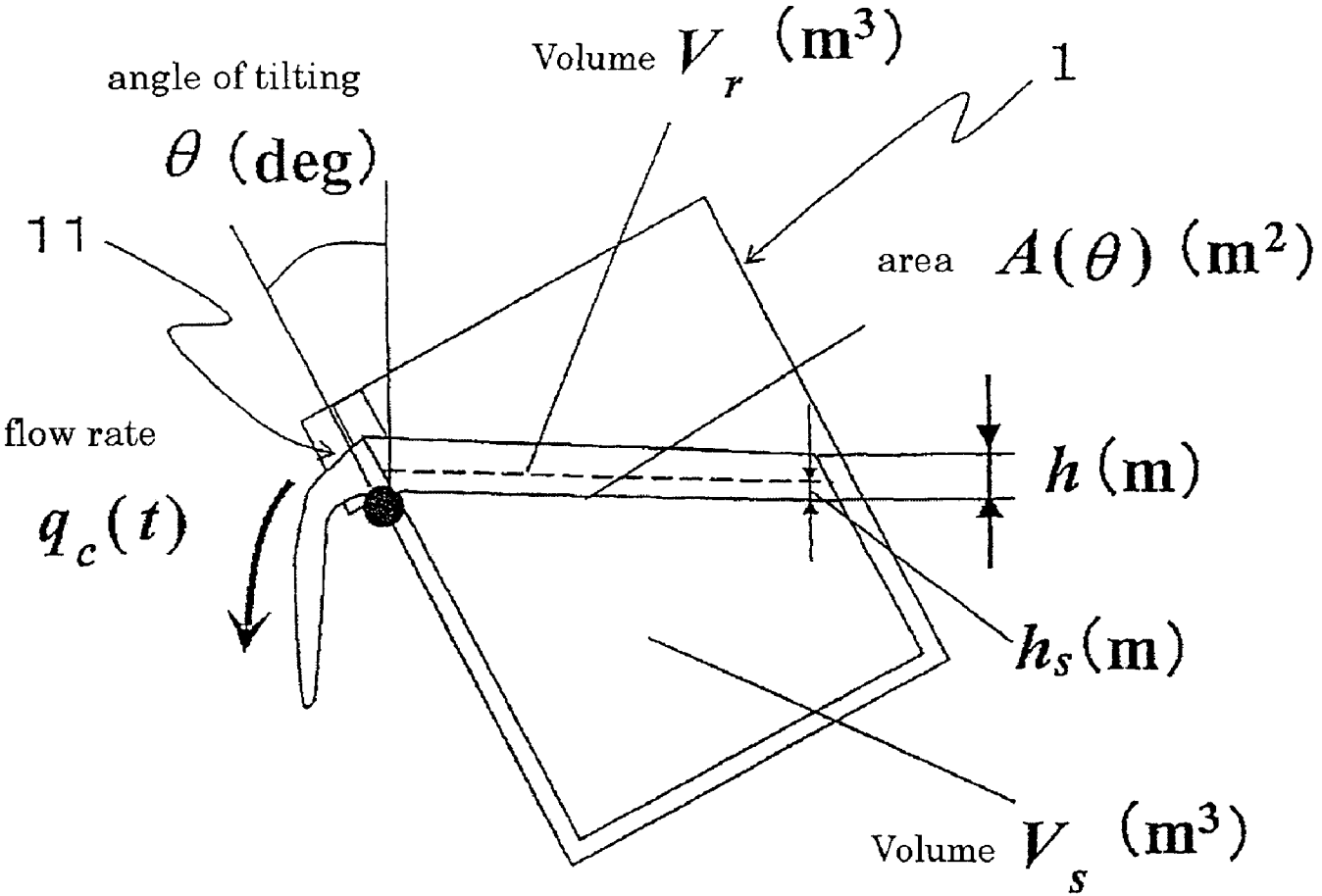
FIG. 2 is a schematic view of the cross section of the ladle in the tilting-type automatic pouring equipment that is in the operation of pouring, of FIG. 1.
Figure 3:
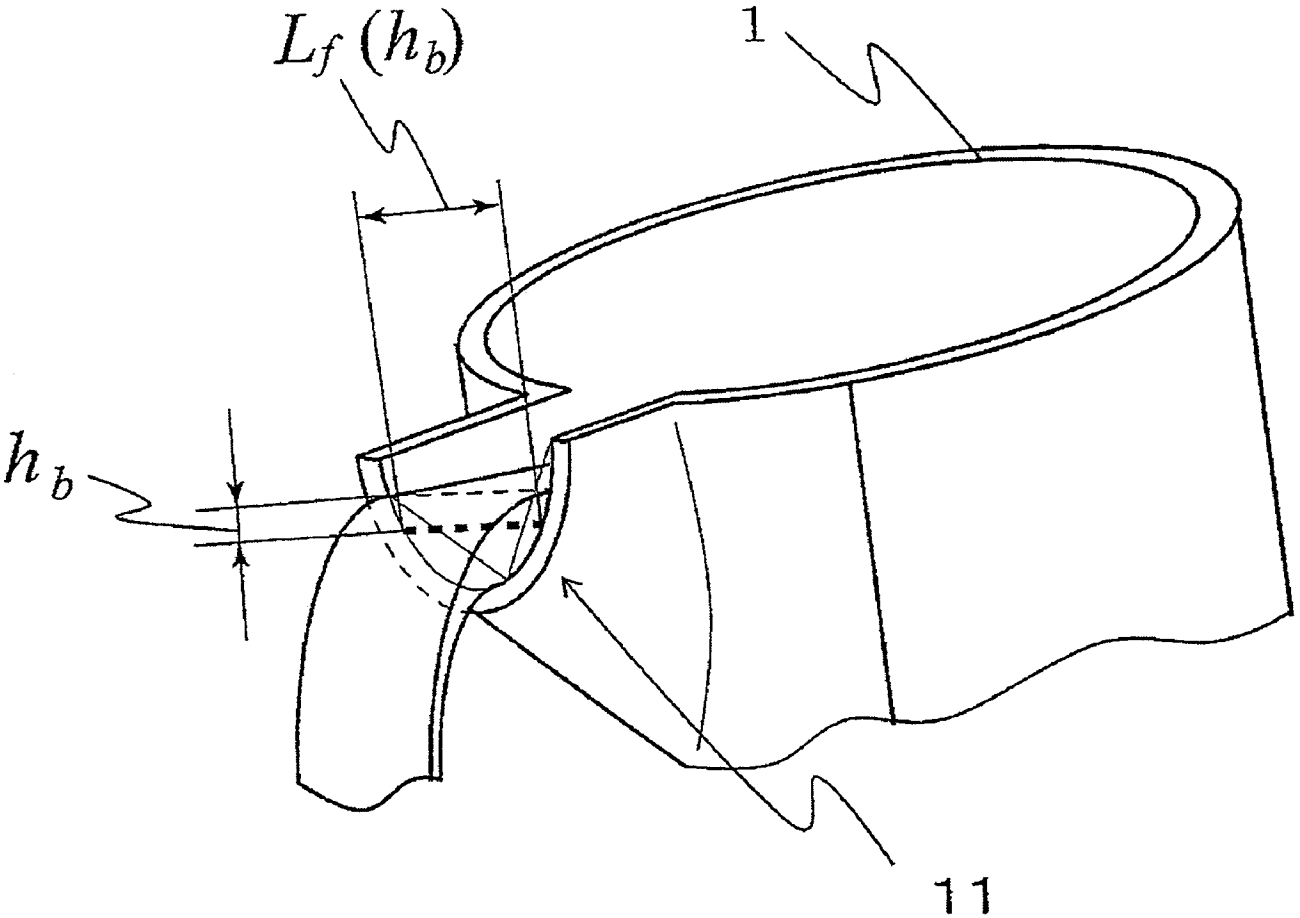
FIG. 3 is a perspective view of the tip of the ladle near its outflow position.
Figure 4:
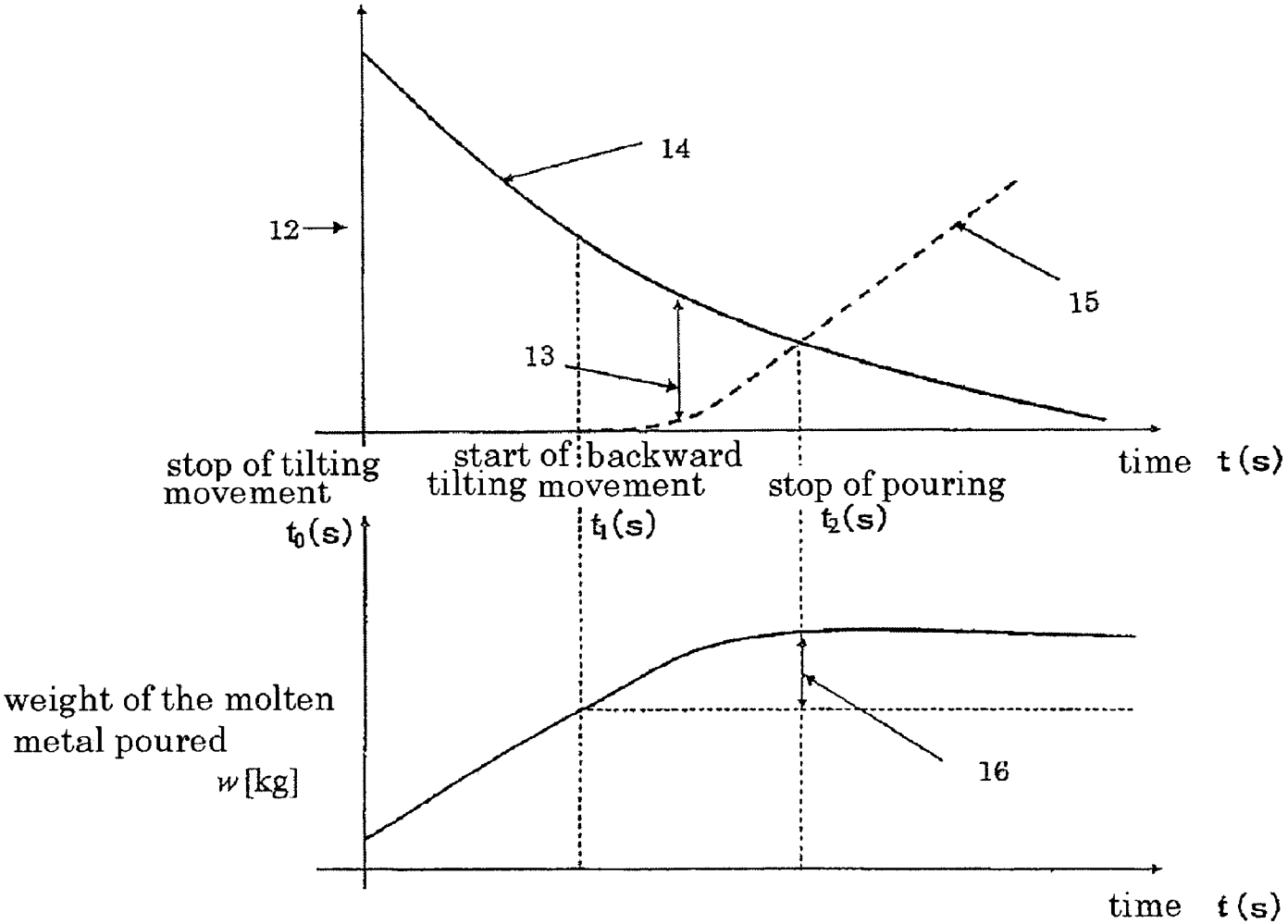
FIG. 4 is a graph that shows the relationship of the height of the molten metal above the outflow position and the weight of the molten metal that is poured.
Figure 5:
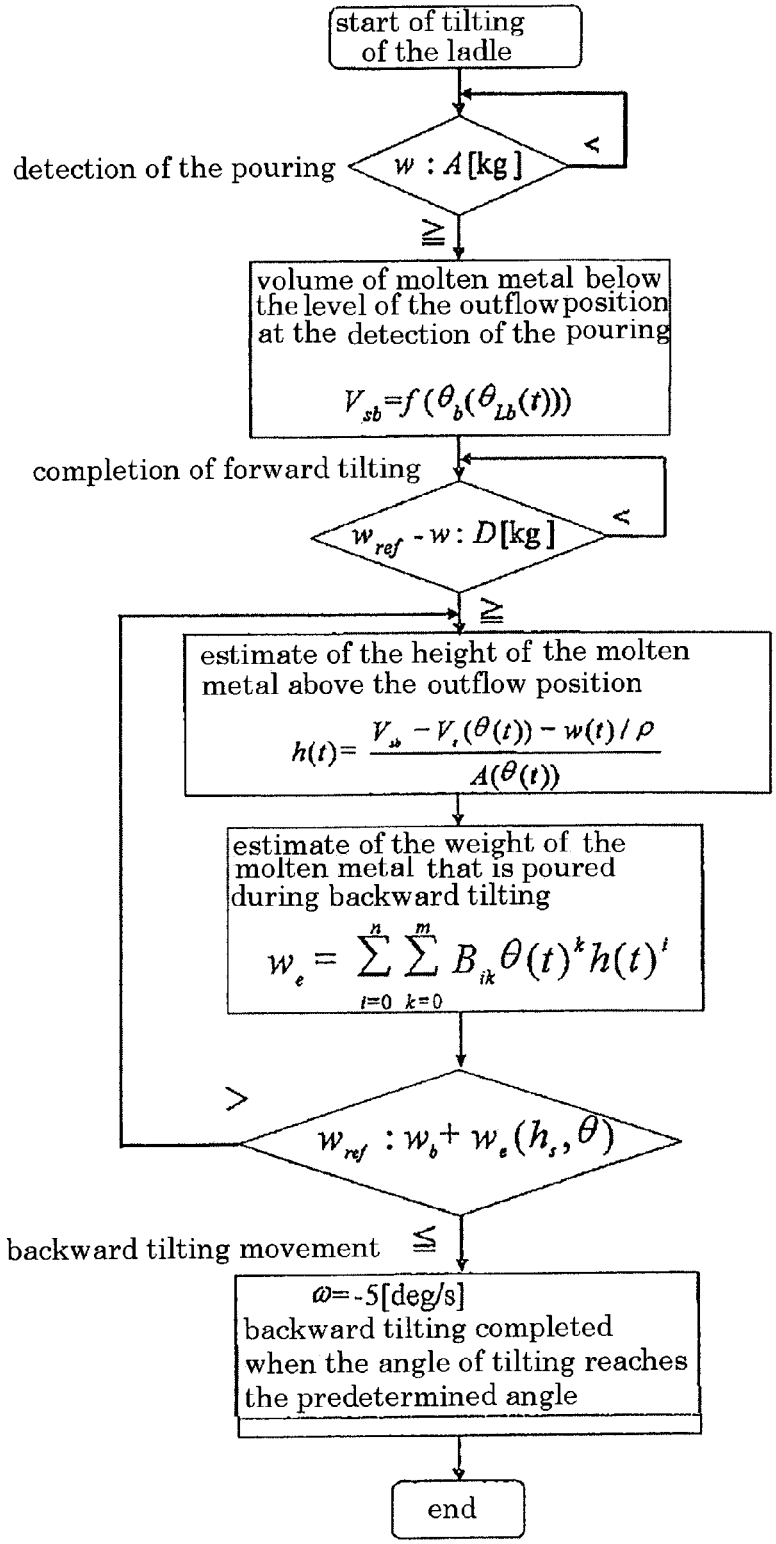
FIG. 5 is a block diagram that shows a process of pouring where the weight that is poured is controlled.
Figure 6:
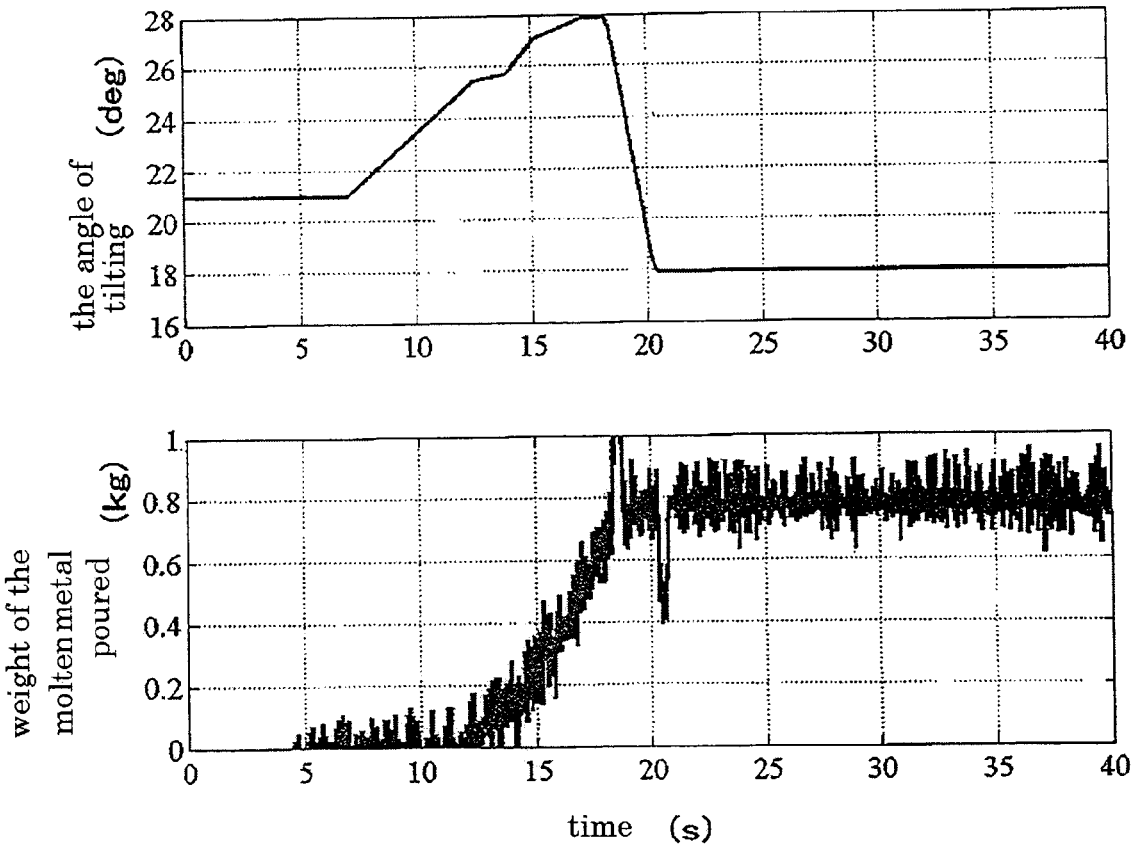
FIG. 6 is a graph that shows the result of the experiment that controls the weight that is poured and that is carried out using the automatic water pouring equipment.

1. ladle
2, 3, and 5. servomotors
4 and 6. transfer means
7. programmable logic controller
8. control system
11. outflow position
12. height of the molten metal
13. height h of the molten metal above the outflow position
14. height of the molten metal when the ladle stops forward tilting
15. decrease of the height of the molten metal in the backward tilting of the ladle
16. weight of molten metal that is poured after the start of the backward tilting of the ladle

The invention claimed is:

1. A tilting-type automatic pouring method for pouring molten metal from a ladle with an outflow position into a mold, the method comprising:

tilting the ladle forward to pour molten metal into the mold;

measuring a weight of poured molten metal;

calculating a flow rate of the molten metal flowing out of the ladle based on the measured weight of poured molten metal;

estimating a weight of molten metal that will be poured during a backward tilting, the estimating comprising:

calculating a height of molten metal above the outflow position based on the flow rate; and estimating the weight of molten metal that will be poured during the backward tilting based on the calculated height;

estimating a total weight of molten metal based on the measured weight of poured molten metal and the estimated weight of molten metal that will be poured during the backward tilting;

comparing the estimated total weight of molten metal to a predetermined weight;

starting, when the estimated total weight is equal to or larger than the predetermined weight, the backward tilting.

2. The tilting-type automatic pouring method of claim 1, wherein the measuring the weight of poured molten metal includes:

obtaining a reading of a load cell used to measure the weight of poured motel metal; and obtaining the measured weight of poured molten by calibrating the reading of the load cell based on a response characteristics of the load cell.

3. A non-transitory computer-readable storage medium storing computer instructions which, when executed by a computer, perform a method comprising:

tilting the ladle forward to pour molten metal into the mold;

measuring a weight of poured molten metal;

calculating a flow rate of the molten metal flowing out of the ladle based on the measured weight of poured molten metal;

estimating a weight of molten metal that will be soured during a backward tilting, the estimating comprising:

calculating a height of molten metal above the outflow position based on the flow rate; and estimating the weight of molten metal that will be poured during the backward tilting based on the calculated height;

estimating a total weight of molten metal based on the measured weight of poured molten metal and the estimated weight of molten metal that will be poured during the backward tilting;

comparing the estimated total weight of molten metal to a predetermined weight;

starting, when the estimated total weight is equal to or larger than the predetermined weight, the backward tilting.

* * * * *